United States Patent [19]

Gennari et al.

[11] Patent Number: 5,049,355

[45] Date of Patent: Sep. 17, 1991

[54] PROCESS FOR PRODUCING AN ODS SINTERED ALLOY

[75] Inventors: Udo Gennari, Pflach; Wolfgang Glätzle, Reutte, both of Austria

[73] Assignee: Schwarzkopf Development Corporation, New York, N.Y.

[21] Appl. No.: 449,909

[22] PCT Filed: Apr. 13, 1989

[86] PCT No.: PCT/EP89/00396

§ 371 Date: Jan. 8, 1990

§ 102(e) Date: Jan. 8, 1990

[87] PCT Pub. No.: WO89/09840

PCT Pub. Date: Oct. 19, 1989

[30] Foreign Application Priority Data

Apr. 14, 1988 [AT] Austria ..... 963/88

[51] Int. Cl.[5] ..... B22F 3/12; B22F 5/00

[52] U.S. Cl. ..... 420/425; 148/11.5 P; 148/12.7 B; 148/133; 148/421; 419/19; 419/46; 419/47; 420/427

[58] Field of Search ..... 420/425, 427; 148/11.5 P, 12.7 B, 133, 421; 419/19, 46, 47

[56] References Cited

U.S. PATENT DOCUMENTS 3,434,811 3/1969 Foldes ..... 29/182.5
3,821,036 6/1974 Copeland et al. ..... 148/126
4,622,068 11/1986 Rowe et al. ..... 419/46
4,744,945 5/1988 Hamajima et al. ..... 420/590
4,873,052 10/1989 Hasker et al. ..... 419/19
4,894,086 1/1990 Huether et al. ..... 419/46

FOREIGN PATENT DOCUMENTS 1232353 1/1967 Fed. Rep. of Germany .
1290727 11/1969 Fed. Rep. of Germany .
3030751 3/1982 Fed. Rep. of Germany .
472504 6/1969 Switzerland .

*Primary Examiner*—Upendra Roy
*Attorney, Agent, or Firm*—Morgan & Finnegan

[57] ABSTRACT

Process for producing a ductile, high strength, oxide dispersion hardened sintered alloy based on a metal having a high melting point. In the past, oxide dispersion has played only a minor role in comparison with other known processes for increasing strength. The process disclosed permits cost effective production of metallic materials which possess a strength hitherto unattainable by oxide dispersion and a higher ductility than prior art materials. As a result, the metallic and nonmetallic foreign components in the sintered alloy can be restricted to the relatively small quantities of dispersoids and any dissolved residual oxygen. The process consists in an annealing treatment and calls for a specific choice of basis metal and suitable oxide dispersoid. The materials so obtained are used mainly where metallic components possessing high strength and ductility together with a minimal concentration of foreign elements are required, for example in human medicine where stringent requirements concerning corrosion resistance and biocompatibility apply or in nuclear technology to prevent undesirable particle reactions.

9 Claims, No Drawings

PROCESS FOR PRODUCING AN ODS SINTERED ALLOY

BACKGROUND OF THE INVENTION

1. Field of the Invention

The invention concerns a process for manufacturing a ductile, high strength, oxide dispersion hardened sintered alloy based on a metal with a high melting point, if necessary with small additions of substitution mixed-crystal phase which, however, do not have a serious effect on alloy properties, in which a metal oxide powder in dispersoid form is mixed with the basic metal powder, using oxides of those metals whose binding energy at temperatures $<0.5\ T_M$ is higher than that of the oxides of the basic metal.

2. Description of Related Art

Classical processes for altering the strength properties of metals include the forming of alloys via mixed-crystal phases and mechanical reshaping. In addition, it is known that the strength of materials produced by fusion metallurgy or powder metallurgy can be increased by introducing or removing dispersoids. According to the definition, dispersoids are particles, usually included in the metallic base matrix in a continuous fashion, which even at higher temperatures do not react with the basic metal or dissolve, and are not built into the base lattice as substitution metals. Particularly oxides, carbides and nitrides are used as dispersoids.

According to established doctrine, the disadvantage of dispersion hardening versus alloy hardening by continuous or discontinuous precipitation of a second phase within the basic phase from a common solution (precipitation hardening consists in the fact that "it is hardly possible to achieve the same degree of dispersion and strength increase as can be realized with precipitation processes in many cases" (H. Böhm, Introduction to Metallurgy, Hochschultaschenbücher Verlag, Mannheim, Zürich).

For producing dispersion-hardened alloys by processes of powder metallurgy, the dispersoids are usually introduced by soaking the powder with a dispersoid suspension, or by blending dispersoids in powder form with the basic metal powder.

Dispersoids introduced in this manner can be further homogenized by "mechanical alloying". The objective of mechanical alloying is to distribute the dispersoids as homogeneously as possible, even within the individual metal powder grains. These processes are very time-consuming and require grinding equipment of high quality. They are therefore very expensive, and their applicability depends on the state of the components. Moreover, practical application demands a compromise between the degree of homogenization and the cost of grinding, i.e. the grinding operation is limited in time.

The application DE-A1 35 4 255 contains a proposal for producing an ODS alloy by mixing the basic metal in the form of a salt solution with the dispersion particles in colloidal suspension and to finally reduce it to metal. As a special advantage, the finely distributed, homogeneous introduction of the dispersoid into the metal matrix is cited. However, even with this process, distribution is limited by the particle size of the components.

The production of dispersion hardened alloys consists in introducing particles as dispersoids which by definition do not react or alloy with the basic matrix. In connection with this fact, the sintered-metallurgy processes for producing dispersion alloys up until the present have used dispersoids with melting points that are usually considerably higher than the alloy sintering temperature. The dispersoids exist in the solid phase during the entire manufacturing process.

Due to the doctrine mentioned above, that dispersion hardening achieves only relatively small increases in strength, the additional means of mixed-crystal alloy hardening or precipitation hardening was applied in cases where greater mechanical strength was required. To achieve this, greater doses of additive metals were blended with the basic metals, next to dispersoids.

Next to powder metallurgy processes, it is known that oxide dispersion alloys of high-melting metals can be produced by fusion metallurgy, particularly by arc melting.

For instance, a process is known from DE-C1 12 90 727 for producing a niobium alloy of high strength by adding to the niobium small amounts of oxygen, carbon and/or nitrogen, plus possibly larger amounts of other high-melting metals, next to 0.5–12% zirconium. This alloy melted in the arc is then solution-annealed at 1600°–2100° for between 5 minutes and 9 hours, cooled, reshaped and finally subjected to precipitation annealing. The patent description states that, during solution annealing, the second phase—meaning the carbides, nitrides and/or oxides contained in the basic matrix (basic metal) after melting—forms a solution with the basic matrix. According to that invention, the second phase is to remain in solution during the cold shaping due to the solution annealing and subsequent quenching, and is to be precipitated homogeneously and finely during precipitation annealing. The quality that can be achieved is documented by means of examples as well as in the form of tables of mechanical properties.

According to this patent, the means of substitution mixed-crystal alloying as well as precipitation hardening is used in conjunction with the means of dispersion hardening, cited in column 1, line 65 of the description, for increasing the mechanical strength of such alloys. The strength values that are realized are thus the result of two or three strength- and hardness-increasing processes going on simultaneously.

The relatively small amounts of O, but also N and/or C in the alloy indicate that the precipitation of oxides as a means for increasing strength plays a relatively minor role in that case. In Example 1, mention is made of remelting the ingot six times in order to assure a useful—but, due to the process used, certainly not good—homogenization of the metals and dispersoids. Even so, the process is comparatively expensive. After melting and also still after hot reshaping, such alloys have a relatively coarse grain which degrades material strength. For this reason, the description in column 1, line 015 etc. expressly warns "not to prolong the solution annealing of the sheet metal unnecessarily in order to prevent grain growth".

Room temperature data are not given in the description. Experience shows that in alloys produced with this process, relatively high strength can be expected, but at the same time ductility at room temperature will be low (see e.g. V. G. Grigorovich and E. N. Sheftel, Met. Sci. and Heat Treatment 24 (7–8), p. 472 (1983).

U.S. Pat. No. 3 181 966 describes a basic niobium alloy containing 0.25–0.5% oxygen and/or 1–3% zirconium and/or titanium, with a weight ratio of oxygen/titanium or zirconium between 3:1 to 12:1. In that case, strengthening of the material is achieved by means of oxide dispersion hardening, plus, corresponding to the examples quoted, also to a certain extent by oxygen in interstitial solution and by alloying niobium with titanium and/or zirconium. It is pointed out there that higher contents of oxygen in interstitial solution will cause great brittleness in the niobium. In order to counteract this effect, that process makes use of metal oxides of metals having a higher bond energy (negative bond enthalpy) than that of the basic metal only in the presence of excess oxide metal. The additions are added, e.g. as titanium oxide powder and spongelike titanium metal, during an arc remelting process of the highly purified niobium. The process of cooling, which is important for the form of dispersion precipitation, is paid no attention in the patent description. This process does not permit any very fine distribution of the dispersoids in the basic metal.

The feasible strength properties of niobium alloys that had undergone additional hot reshaping but no recrystallization are summarized in a table and compared with the properties of pure, commercially available niobium qualities. They will later serve as comparative data for the strength increases possible with the process of this invention.

The invention at hand has as its objective the development of a process to produce ODS sintered alloys having high ductility and strength properties, using a high-melting basic metal, which is more economical than known processes. The strength properties of alloys produced with known metallurgical processes should be at least equaled, both in the deformed and in the recrystallized state, without making use of the formation of substitution mixed crystals or of the classical precipitation of a second metal or compound phase as means to achieve increased strength.

SUMMARY OF THE INVENTION

The process should make possible very precise control of the extent of dispersion hardening. The ductility of the alloy should be adequate even for subsequent cold shaping of the material.

The properties of a single metallic element, such as its corrosion behavior and its properties when exposed to radiation, should as much as possible remain unaffected by foreign elements, and at the same time, the mechanical strength of the metals should be significantly increased over that of the pure phase, with or without deformation hardening.

According to the invention, this task is accomplished by a process in which a pressed blank formed of the powder mixture is sintered, with temperatures at least temporarily reaching 0.7–0.9 $T_M$, while the following processes occur:

the oxide that was introduced is broken down and/or is reduced by the basic metal, the components which are formed are dissolved in the basic metal;

the dissolved components are finely distributed in the basic metal due to diffusion;

part of the total oxygen present in the alloy evaporates in a controlled manner, preferably as an oxide of the basic metal, from the surface of the sintered object.

DETAILED DESCRIPTION OF THE PREFERRED EMBODIMENTS

Due to the characteristics of the invention as stated, the process will be applicable to but a limited number of alloys. Among the metals having high melting points, primarily those of subgroup V and VI of the periodic system will be suitable. Due to the free negative bond energy, only a limited number of oxides are usable in each case for the desired dispersion hardening. The table below gives an overview of oxides which are at least applicable in individual cases and their free bond energy, and for comparison shows the oxides of some high-melting metals having comparatively low bond energy values:

TABLE

| Solution metal | Solution metal oxide and hard, temperature-resistant metal oxide | Approximate value of the negative free oxide bond energy at 25° C. in kilojoules per gram atom of oxygen |
|---|---|---|
| Silicium | $SiO_2$ | 403 |
| Titanium | $TiO_2$ | 424 |
| Zirconium | $ZrO_2$ | 512 |
| Aluminum | $Al_2O_3$ | 529 |
| Beryllium | BeO | 584 |
| Thorium | $ThO_2$ | 613 |
| Chromium | $Cr_2O_3$ | 348 |
| Magnesium | MgO | 572 |
| Manganese | MnO | 365 |
| | $MnO_2$ | 233 |
| Lanthanum | $La_2O_3$ | 580 |
| Hafnium | $HfO_2$ | 566 |
| Barium | BaO | 529 |
| Strontium | SrO | 560 |
| Calcium | CaO | 605 |
| Yttrium | $Y_2O_3$ | 604 |
| Niobium | $Nb_2O_5$ | 357 |
| Tantalum | $Ta_2O_5$ | 388 |
| Vanadium | VO | 416 |
| Molybdenum | $MoO_2$ | 251 |
| | $MoO_3$ | 227 |
| Tungsten | $WO_2$ | 251 |
| | $WO_3$ | 247 |
| Rhenium | $ReO_3$ | 189 |

An essential factor which governs the choice of suitable combinations of basic metal and dispersoid from case to case is the solubility of the oxygen and the oxide metal in the basic metal at the applicable sintering temperature, as well as the melting point of the oxide metal itself. A solubility which is too low, or the formation of intermetallic compounds between the oxide metal and the basic metal, preclude certain combinations of metal and oxide, or at least limit the attainable dispersoid percentage in the alloy.

All of the three processes which proceed concurrently during solution annealing according to the invention are known in themselves, and so are the means and measures to assure a well-controlled implementation of these processes. It is therefore feasible for the average professional to take appropriate steps in each specific case to attain the desired balancing between the three processes.

The concentration of the oxide in the basic metal essentially determines the temperature at which the various processes specified by the invention occur, or become dominant compared to the others. By adapting the sintering time and temperature to the components present in the alloy at hand, as well as to their concentration, it is possible to achieve the three processes for oxide homogenization in the course of the sintering process.

The total oxide content in the sintered material should preferably be set in such a way that only the exact stoichiometric amount required for forming the oxide remains, which in the strict sense is valid only for the center of the sintered object due to a diffusion-controlled concentration profile. In certain cases, the oxide content will be set to a lower value, i.e. below the stoichiometric level, in order to prevent an excessively rapid—and thus usually coarse-grained—precipitation of the oxide during cooling after the annealing treatment; this at the expense of a slight reduction in strength.

An excess of oxygen in the material to be sintered will lead to oxygen in interstitial solution next to completely precipitated oxide. An oxygen deficit results in incomplete oxide precipitation. In the latter case, part of the oxide metal remains in solution in the basic matrix and will therefore act as a getter for impurities—but also as a mixed-crystal component.

Since any excess oxygen in interstitial solution which is not precipitated as oxide will result in an added increase in strength on the one hand, but on the other also causes a decrease in ductility, practical application demands that an optimum of all influencing factors be determined which takes all requirements into account.

The sintering and annealing process can be carried out by means of direct sintering as well as by indirect sintering. In the direct sintering process, the material to be sintered is heated by a direct passage of current. The required water cooling of the connectors permits an especially rapid cooling of the material to be sintered when the sintering process is ended.

Subsequent to the sintering process with solution annealing, the precipitation in the form of very fine, homogeneously distributed oxide particles will already occur during the cooling phase, or during a subsequent precipitation annealing step, depending on the dispersoid and its concentration. In this process, the rapidity of cooling plays an important part, the more so the higher the oxide concentration in the alloy. Directly sintered material can be quenched to low temperatures particularly quickly. By heating the alloy, e.g. before extruding as a first reshaping process, the precipitation of the oxide particles is in certain cases made possible in the first place, or is made complete.

In order to apply mechanical reshaping processes, especially cold shaping by forging, rolling or hammering, the oxide dispersion alloy according to the invention must have adequate ductility in addition to high strength. It is therefore important to position the strength properties of the alloy according to the invention as closely as possible to a limit which can still just be tolerated, by choosing the dispersoid concentration, but above all by correct control of the solution annealing step according to the invention.

According to a preferred form of implementation of the invention, the alloy consists of niobium or tantalum as a basic metal and contains, next to small amounts of oxygen in solution, essentially 0.2–1.5% by weight of oxide, using one or more of the metals Ti, Zr, Hr, Ba, Sr, Ca, Y, La.

Particularly outstanding results are obtained with a niobium alloy containing 0.2–1% by weight of titanium and oxygen, where, next to small amounts of oxygen in interstitial solution in the niobium basic matrix, $TiO_2$ is present as a finely distributed dispersoid in the basic matrix. Another preferred niobium alloy contains 0.2–1.5% by weight of $ZrO_2$.

It was surprising, and not predictable in the extent it occurred, to find the unusually high strength values achieved through the invention, at a comparably high ductility for dispersion sintered alloys. For instance, in the publication "Niobium, TMS-AIME, Proceedings of the International Symposium 1981, ed. H. Stuart (1984)" it is stated on page 247 that dispersion hardening in Niobium can be attained only to a very slight extent due to the lack of dispersoids with a sufficiently fine distribution. Even in those cases where alloys were produced using fusion metallurgy with annealing methods roughly comparable as to temperature and time, the results of the invention at hand could not even be approximated. Rather, it has to be assumed that due to the different conditions prevailing, in the other process the three processes which occur next to sintering in the invention at hand cannot be balanced with each other in a comparable manner. In particular, the metal component of the disintegrating oxide in melted alloy material will evaporate much more easily from the alloy, compared to sintered alloys. It therefore does not get a chance to disperse in the basic metal relatively homogeneously.

To the extent that oxide dispersion alloys have so far been produced by means of sintering, the sintering process took place at relatively much lower temperatures than in the invention at hand. This was to make sure that the oxide particles distributed within the stamped part would remain in the place where they were introduced with as little change as possible and stationary.

It was surprising that the annealing treatment according to the invention was indeed feasible to the extent actually achieved. According to prevalent doctrine, it had to be feared that, at the annealing and sintering temperatures utilized in the invention, the dissolved oxide metals would also evaporate from the surface of the sintered object at high rates, next to the oxides of the basic metal. For, if the required conditions for oxide bond energies are met, the melting points of the oxide metals can be significantly lower that the desirable annealing temperatures according to the invention, and are indeed lower than the annealing temperatures in preferred forms of implementation.

A significant advantage of the process according to the invention is its economy. To the extent that dispersion alloys have until now been produced by fusion metallurgy, including roughly comparable annealing methods, the total manufacturing process has been significantly more cost-intensive—e.g. due to melting and remelting of the oxides in the ingot by means of arc melting—while the strength gain was clearly less.

Based on the strength values that can be achieved by the various processes, it may be assumed that ODS sintered alloys according to the invention will achieve much finer oxide particles and homogeneous dispersoid distributions in the basic matrix than with conventional fusion metallurgy processes including an annealing treatment. As an additional advantage, sintering consistently yields a much finer grain than fusion metallurgy.

A significant economic advantage of the process according to the invention stems from the integration of the annealing treatment according to the invention into the overall sintering process required.

Comparable high-strength alloys—especially at room temperature and medium elevated temperatures—have until now been obtained for the basic metal in question only by the formation of a mixed-crystal phase, in some cases with the precipitation of a second metal phase. Intentionally omitting the formation of a mixed-crystal phase has the following advantages:

ODS sintered alloys have comparably high ductility and can therefore be reshaped much more economically to achieve higher final strength values;

these alloys are consistently more corrosion-resistant than those produced by known processes;

typical properties of individual basic metals which are essential for their applicability, such as extreme corrosion resistance and therefore biocompatibility in the case of human implants, but also the use of e.g. niobium due to its low neutron capture cross-section, are practically unaffected by the low dispersoid concentrations.

Materials produced according to the process described are required in chemical manufacturing just as much as in tools for high-speed shaping of special alloys, such as super alloys.

An important field of application of niobium and tantalum alloys exists in implants in human medicine. The use of such extremely pure niobium and tantalum alloys, which are known to be especially compatible with human tissue, until now has failed in many cases due to their insufficient strength properties. Niobium and tantalum alloys produced by the process according to the invention therefore broaden the application area in implant medicine considerably.

A promising application area for alloys according to the invention lies in piping systems for alkaline metal cooling circuits, such as in nuclear plants.

The excellent strength properties of alloys according to the invention will be illustrated in conjunction with the following examples.

EXAMPLE 1

An alloy of niobium with 0.5% $TiO_2$ by weight is produced by the process according to the invention. For this purpose, 3980 grams of niobium powder having a mean grain size of 10 $\mu$m and an oxygen content of $<1000$ ppm is blended homogeneously for one hour with 20 grams of $TiO_2$ powder agglomerate having a mean grain size of 0.25 $\mu$m.

This powder mixture is then pressed hydrostatically at about 2000 bar down to 80% of theoretical density.

The pressed object thus obtained is heated slowly under a high vacuum (less than $1\times10^{-5}$ mbar) and is finally sintered for 12 hours at a temperature of 2100° C. These sintering conditions are geared to the size of the samples and to the diffusion and degassing processes to be realized. This leads to a disintegration and the formation of a solid solution of the $TiO_2$, as well as to the diffusion of the Ti and $O_2$ components in the niobium. In addition, part of the oxygen is evaporated from the surface of the sintered object, primarily in the form of niobium oxide.

This results in a very homogeneous distribution of titanium and oxygen, achieving a stoichiometric proportion in the core area of the sample, and in a slightly sub-stoichiometric proportion as to oxygen in the peripheral area of the sample. Further, it was found that the concentration of the titanium over the entire cross-section of the sintered object is nearly constant, except for a border zone in the mm area.

Due to the low concentration of $TiO_2$ in the alloy, there is no significant precipitation of $TiO_2$ during the cooling period following the sintering step, but a nearly complete precipitation during a preheating and precipitation step of about one hour at the start of the hot reshaping process. Electron microscopic analyses of samples following the precipitation annealing step showed that the alloy contained very homogeneously distributed, fine-grained $TiO_2$ particles with a particle size of 2–20 nm, predominantly in the range 8–12 nm.

Such alloys can be further processed by the known hot and cold reshaping processes. In the case at hand, the first step is a hot reshaping by extrusion at 1000° C. with a reshaping ratio of 8.7:1. The alloy sample was then processed further by profile rolling and round hammering to a cold reshaping factor of 72%. It was possible without any problem to increase the cold reshaping factor up to 99.9% without intermediate annealing.

Strength tests were then conducted with standard samples made of rods of 8 mm diameter. The resulting strength values are summarized in Table 1 under Position 1. The table shows two sets of tensile strength at room temperature, 800° C., 1000° C. and 1200° C., both for the deformed sample and after recrystallization for 1 hour at 1400° C. The table contains the appropriate elongation values next to the tensile strength.

Next to tensile strength, the fatigue strength of such alloys was also tested. The measurements, using an ultrasonic method, showed above-average results, with a fatigue strength of about 400 $N/mm^2$ in air after $2\times10^8$ cycles.

The alloy possesses excellent ductility. This shows up, for one thing, in excellent machinability, and also in a very low transition temperature of about $-50°$ C., a high notch impact strength of about 135 $J/cm^2$ at room temperature and a high breaking elongation of $>10\%$ with deformed material.

EXAMPLE 2

An oxide dispersion hardened niobium-1 $TiO_2$ alloy was produced, using the process described in Example 1. Twice as much $TiO_2$ was added as in Example 1.

In contrast with Example 1, a partial precipitation of $TiO_2$ was observed in this case even during the cooling period following the sintering and reaction annealing process. When the alloy was preheated prior to the hot reshaping process, the titanium still in solution was precipitated practically entirely as $TiO_2$.

The increased $TiO_2$ content of the alloy caused a higher deformation resistance, so that the samples can better be annealed in between the individual steps of cold reshaping in order to attain a more even structure.

The tensile strength and elongation measured with this sample are shown in Table 1 under Position 2.

EXAMPLE 3

A Niobium-0.5 $ZrO_2$ alloy was produced according to the process steps described in Example 1.

Particularly in view of the rapid cooling of the sintered material after sintering and annealing, the pressed powder blank was processed further by way of direct sintering.

Since $ZrO_2$ is more stable than $TiO_2$, the sintering temperature was increased to 2300° C. in order to assure on the one hand that the $ZrO_2$ components would dissolve completely, but on the other hand also to obtain a somewhat lower total oxygen content of the sample so as to prevent an overly rapid and comparatively coarse re-precipitation of the oxide during the cooling of the sample following the sintering process. A rapid cooling of the sintered object was assured by known measures.

Taking into account the higher stability of $ZrO_2$ as compared to $TiO_2$, the preheating or precipitation temperature preceding the first hot reshaping step was increased by 100° C. to 1100° C.

Further process steps were carried out corresponding to Example 1.

The tensile strength and elongation data in the reshaped as well as in the recrystallized state are shown in Table 1 under Position 4.

Table 1 shows in Positions 1 through 7 the tensile strength and associated elongation data at various temperatures for a number of different samples.

The samples are:

Position 1 an Nb-$TiO_2$ alloy as described in Example 1 of the invention at hand Position 2 an Nb-$TiO_2$ alloy as described in Example 2 of the invention at hand Position 3 an Nb-1.5 Ti-0.5 O alloy as described in U.S. Pat. No. 3,181,945, quoted with respect of the state of the art Position 4 an Nb-$ZrO_2$ alloy as described in Example 3 of the invention at hand Position 5 an Nb-1 Zr alloy according to the state of the art ("Niobium, TMS-AIME Proceedings of the International Symposium 1981")

Position 6 an Nb-1 Zr-0.25 O alloy as described in U.S. Pat. No. 3,181,945, quoted with respect of the state of the art Position 7 a very pure Niobium material according to values cited in the literature and our own measurements.

The results according to the invention cannot be entirely compared with the values cited in the literature, since, for one thing, the deformation process of the samples according to the state of the art as quoted was not described in detail, and also because on the basis of the detailed description given, it must be assumed that next to oxide dispersion precipitates the alloy also still contained significant percentages of oxide metals of the dispersion oxides in the basic matrix, exerting an alloy effect which acts to increase strength.

However, it can be stated purely in a qualitative sense that state-of-the-art technology cannot produce strength values comparable to those of the invention at hand. The data for pure Niobium in Position 7 show that dispersion alloys produced according to this invention can attain much higher strength properties, at least at room temperature, than by reshaping and possibly recrystallizing pure Niobium.

TABLE 1

| Pos. | Material % by weight | State | Test temp. °C. | Tensile str. MP a | Elongation % |
|---|---|---|---|---|---|
| 1 | Nb—0.5 $TiO_2$ | reshaped | RT | 950 | 12 |
| | | | 800 | 405 | 12 |
| | | | 1000 | 350 | 12 |
| | | | 1200 | 250 | 15 |
| | | recryst. | RT | 490 | 34 |
| | | | 800 | 175 | 33 |
| | | | 1000 | 135 | 46 |
| 2 | Nb—1 $TiO_2$ | reshaped | RT | 1100 | 12 |
| | | recryst. | RT | 535 | 29 |
| 3 | Nb—1.5 Ti—0.5 O | hot | RT | 506 | 29 |
| | (US-PS 3 181 946) | reshaped | 871 | 307 | 19 |
| | | | 982 | 251 | 14 |
| | | | 1204 | 185 | 20 |
| 4 | Nb—0.5 $ZrO_2$ | reshaped | RT | 760 | 11 |
| | | recryst. | RT | 450 | 32 |
| 5 | Nb—1 Zr | reshaped | RT | 350–550 | 5–15 |
| | (Niobium | recryst. | RT | 290 | 35 |
| | TMS-AIME) | | 800 | 190 | 18 |
| | | | 1000 | 135 | 32 |
| | | | 1200 | 90 | 77 |
| 6 | Nb—1 Zr—0.25 O | hot | RT | 530 | 16 |
| | (US-PS 3 181 946) | reshaped | 982 | 312 | 17 |
| | | | 1093 | 224 | 26 |
| 7 | Niobium pure | reshaped | RT | 300–550 | 2–15 |
| | | recryst. | RT | 200–300 | 20–45 |

TABLE 1-continued

| Pos. | Material % by weight | State | Test temp. °C. | Tensile str. MP a | Elongation % |
|---|---|---|---|---|---|
| 8 | Ta—0.5 $TiO_2$ | reshaped | RT | 890 | 13 |
| | | recryst. | RT | 470 | 31 |
| 9 | Tantalum pure | reshaped | RT | 450–650 | 2–7 |
| | | recryst | RT | 300–350 | 35–55 |

EXAMPLE 4

Analogous with implementation Examples 1 through 3, an alloy is produced consisting of tantalum and 0.5% by weight of $TiO_2$, where the higher melting point of tantalum has to be taken into account for some of the process parameters.

7760 grams of tantalum powder with a mean grain size of 9.5 μm, having an oxygen content of 1050 ppm, are homogeneously blended with 39 grams of $TiO_2$ with a mean grain size of 0.25 μm (the identical oxide powder as in Examples 1 through 3).

In order to avoid too much of an $O_2$ loss due to evaporation of tantalum suboxides (TaO, $TaO_2$), the sintering temperature is set to 2300° C. instead of the usual ca. 2600° C. In this manner, a nearly stoichiometric oxygen concentration is attained, corresponding to the titanium concentration as introduced. The lower sintering density due to the lower sintering temperature is entirely sufficient for complete packing during the subsequent extrusion step. The precipitation annealing step for precipitating very fine $TiO_2$ particles is preferably carried out at 1100° C. in this case.

Due to the high hot strength of the tantalum, extrusion is done at 1200° C. The cold reshaping which follows is carried out by means of profile rollers and round hammering for a total reshaping factor of about 80%.

Under Position 8, Table 1 shows the tensile strength and elongation values in the reshaped state and after recrystallization, again obtained with 8 mm test rods. The high recrystallization temperature (1600° C., 1 hour) leads to a plainly visible coarsening of the $TiO_2$ dispersoids and thus to a weakening of the dispersion hardening compared to the cold-reshaped material. The combination of cold reshaping and dispersion hardening thus results in especially high strength values while retaining adequate ductility. For comparison, Position 9 shows the values for pure tantalum at 82% reshaping, while the manufacturing steps and process parameters correspond to those named above.

We claim:

1. A process for producing a ductile, high-strength, oxide dispersion hardened sintered (ODS) alloy of a base metal having a high melting point (Tm), comprising:

forming a powder mixture by blending a powdered form of said base metal with a dispersoid comprised of a metal oxide powder, said metal oxide powder possessing a higher bond energy value than the oxides of said base metal at temperatures less than 0.5 Tm;

pressing said powder mixture into a pressed blank form; and sintering said pressed blank form at temperatures reaching 0.7–0.9 Tm such that said dispersoid is decomposed into its constituent components, and said constituent components are homogeneously dispersed throughout said base metal.

2. A process for producing a ductile, high-strength, oxide dispersion hardened sintered (ODS) alloy according to claim 1, wherein said ODS alloy includes a small percentage of a mixed-crystal phase of said base metal.

3. The process according to claim 1, wherein said sintering step includes evaporating part of the oxygen present in said ODS alloy from the surface of said pressed blank as an oxide of said base metal.

4. An ODS alloy produced according to claim 1, wherein said base metal comprises a metal from the group consisting of niobium or tantalum;

said ODS alloy contains a small percentage of oxygen; and said metal oxide powder consists of in the range of 0.2–0.5% by weight of said ODS alloy of an oxide of a metal from the group consisting of Ti, Hf, Ba, Sr, Zr, Ca, Y, or La.

5. An ODS alloy produced according to claim 1, wherein said base metal comprises niobium;

said alloy contains dissolved oxygen; and said metal oxide powder consists of $TiO_2$ in the range of 0.2–1% by weight of said ODS alloy.

6. An ODS alloy produced according to claim 1, wherein said base metal comprises niobium;

said alloy contains dissolved oxygen; and said metal oxide powder consisting of $ZrO_2$ in the range of 0.2–1.5% by weight of said ODS alloy.

7. An ODS alloy produced according to claim 3, wherein said base metal consists of metal from the group consisting of niobium or tantalum;

said ODS alloy contains a small percentage of oxygen; and said metal oxide power consists of in the range of 0.2%–0.5% by weight of said ODS alloy of an oxide of a metal from the group consisting of Ti, Hf, Ba, Sr, Zr, Ca, Y, or La.

8. An ODS alloy produced according to claim 3, wherein said base metal comprises niobium;

said alloy contains dissolved oxygen; and said metal oxide powder consists of $TiO_2$ in the range of 0.2–1% by weight of said alloy.

9. An ODS alloy produced according to claim 3, wherein said base metal comprises niobium;

said alloy contains dissolved oxygen; and said metal oxide powder consisting of $ZrO_2$ in the range of 0.2–1.5% by weight of said ODS alloy.

* * * * *